US005363578A

United States Patent [19]

Chesley et al.

[11] Patent Number: 5,363,578

[45] Date of Patent: Nov. 15, 1994

[54] IDENTIFICATION PANEL FOR ELECTRONIC EQUIPMENT CABINET

[75] Inventors: David Chesley, Pepperell; Deborah Falck, Sudbury; Robert L. Hanson, Marlborough; Margaret Hetfield, Arlington, all of Mass.

[73] Assignee: Digital Equipment Corporation, Maynard, Mass.

[21] Appl. No.: 873,319

[22] Filed: Apr. 24, 1992

[51] Int. Cl.[5] ..... G09F 7/00

[52] U.S. Cl. ..... 40/488; 40/491; 312/234

[58] Field of Search ..... 40/491, 488, 152, 152.1; 312/234, 234.1, 204

[56] References Cited

U.S. PATENT DOCUMENTS

| | | | |
|---|---|---|---|
| 3,111,782 | 11/1963 | Quigley | 40/491 |
| 3,913,249 | 10/1975 | Kaslow | 40/488 |
| 4,731,945 | 3/1988 | Howard | 40/491 |
| 4,742,632 | 5/1988 | Salam | 40/491 |

*Primary Examiner*—Brian K. Green

*Attorney, Agent, or Firm*—Clayton L. Satow; Barry N. Young; Albert P. Cefalo

[57] ABSTRACT

An identification panel for a cabinet for electronic equipment, such as computers or computer peripherals. A back panel is mounted to an intermediate window and doorframe member having a control door frame, and a translucent window aligned with the back panel. The back panel may incorporate permanent identifying artwork for the equipment. This assemblage is accommodated in an opening of, and secured to, an external cover frame. The cover frame opening also accommodates a control panel door mounted on the intermediate window and doorframe member to cover the doorframe opening and slidable behind the translucent window to uncover the doorframe opening. The translucent window has a part-cylindrical convex surface which projects through the cover frame opening to provide a lens effect which enhances the visibility of artwork provided on the back panel. Additional artwork, for example model identification, may be provided on a translucent sheet overlaying the curved surface of the translucent window and removably located in position by engagement of the peripheral margins of the sheet between the translucent window and the cover frame.

9 Claims, 4 Drawing Sheets

IDENTIFICATION PANEL FOR ELECTRONIC EQUIPMENT CABINET

FIELD OF THE INVENTION

This invention relates to identification panels and control panels for equipment cabinets, for example cabinets which enclose computers and computer peripherals, and similar electronic devices.

BACKGROUND OF THE INVENTION

Computers, computer peripherals and similar electronic devices are typically enclosed in cabinets. Since it is usually difficult to tell the contents of the cabinet from its appearance, identification panels (often called "banners") are often used to identify the type of device and other information about the device, such as and identifying model number, and the manufacturer of the device.

Control panels for computers and computer peripherals may include indicator lights, switches, and possibly a small disk drive. It is desirable that the control panel be easy to access and observe, yet protected from damage.

Computers and computer peripherals often incorporate subsystems constructed on printed circuit boards. For any given "platform" (that is a family of computer systems), there may be over fifty different model name variations, many of which may be in production at the same time, and all of which may be in service at the same time. Therefore, it is important for a manufacturing line to be able to shift from manufacturing one model to another, quickly and easily.

Computers and peripherals often incorporate subsystems constructed on printed circuit boards. Since models may differ from one another only by the contents of one or more of the printed circuit boards, it is frequently possible to "upgrade" from one model to another simply by replacing one or more printed circuit boards, a relatively simple process.

Thus, for example, a hypothetical "System 100" (a platform) Model 20" (a model) could be upgraded to a "System 100 Model 30" by replacing a circuit board, leaving the other system components the same. When this is done, it is desirable to be able to change the model number identification on the identification banner.

Identification panels may include molded lettering which is inserted into holes that are stamped into the front of the cabinet, and molded plaques, that are inserted through a hole in the cabinet front, usually from the backside.

Both of these techniques are more expensive, and require more complex manufacturing steps and inventory systems than are desirable. Additionally, if a system is upgraded, it may be difficult to change the model number.

The control panel is typically accessed through a cutout portion of the cabinet front, which may be covered by a door. This also adds complexity and expense to the manufacturing process. For example, creating the cutout in a metal cabinet requires a metal stamping step, and it is desirable to cover the sharp edges of the cutout, such as by bending the metal or placing a protective cover over the edges of the cutout. The door also adds a design and manufacturing step.

SUMMARY OF THE INVENTION

The invention provides an identification panel structure including a back panel mounted to an intermediate window and doorframe member having a control door frame, and a translucent window aligned with the back panel. The back panel may incorporate permanent identifying artwork for the equipment. This assemblage is accommodated in an opening of, and secured to, and external cover frame. The cover frame opening also accommodates a control panel door mounted on the intermediate window and doorframe member to cover the doorframe opening and slidable behind the translucent window to uncover the doorframe opening. The translucent window preferably has a part-cylindrical convex surface which projects through the cover frame opening to provide a lens effect which enhances the visibility of artwork provided on the back panel. Additional artwork, for example model identification, may be provided on a translucent sheet overlaying the curved surface of the translucent window and removably located in position by engagement of the peripheral margins of the sheet between the translucent window and the cover frame.

Conveniently, the back panel artwork may be formed by laminated photographic copy, making it relatively inexpensive to produce but nevertheless durable. The translucent sheet overlaying the translucent window likewise is inexpensive to produce, simple to install and readily replaceable. By spacing the back panel from the translucent window, as well as by the use of the translucent artwork sheet overlying the translucent window, an attractive, layered, three dimensional appearance of the overall artwork can be obtained.

The invention is better understood by reference to the drawings, which are described below.

Figure 1:
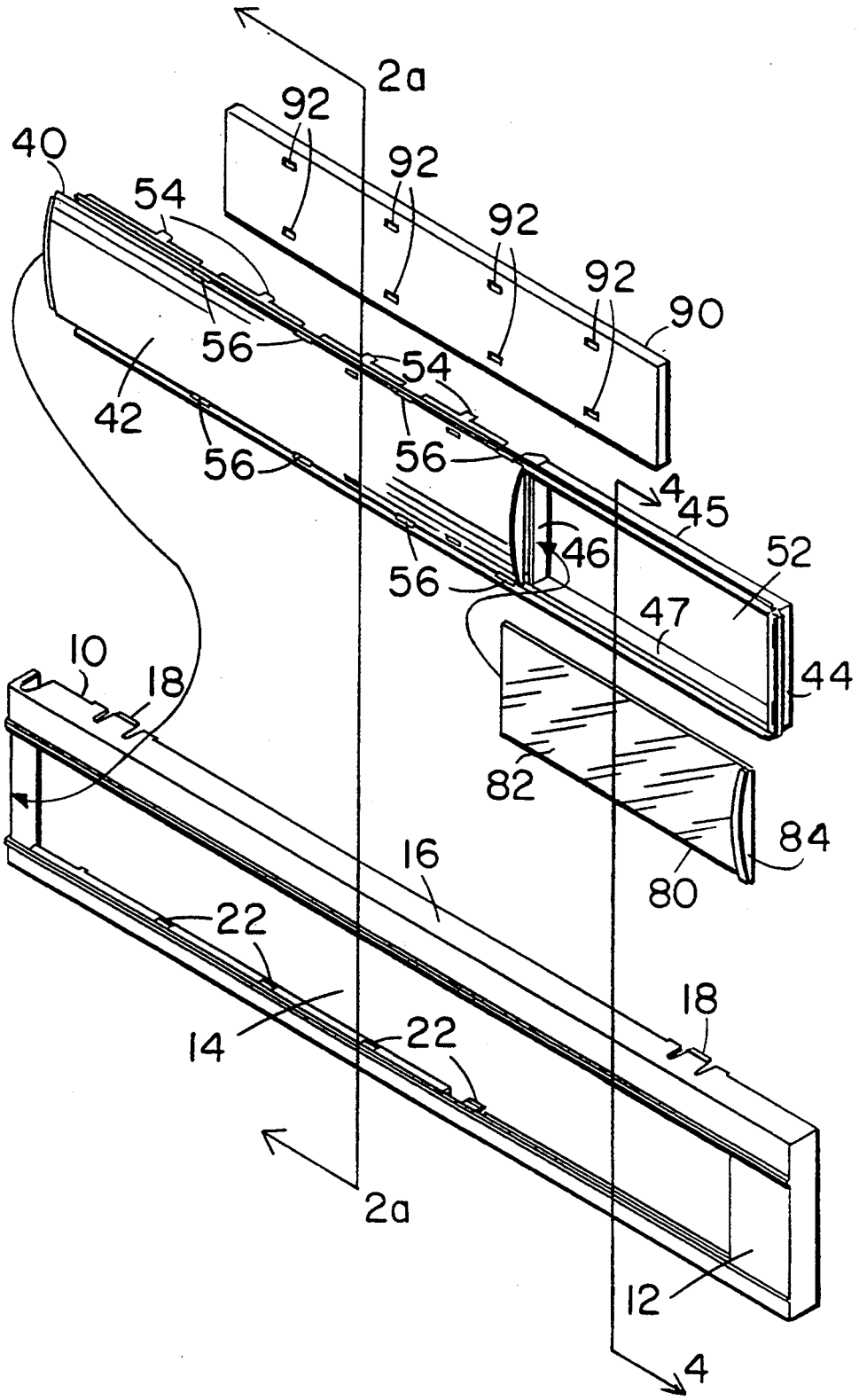
FIG. 1 is an exploded view of an identification panel subassembly embodying the invention.

FIG. *2a* is a cross sectional view of the assembled pieces of FIG. 1 taken along line *2a—2a* of FIG. 1 with the cover frame piece, the window and doorframe piece, and the artwork panel in the assembled position.

FIGS. *2b* and *2c* are partial blowups of the assembled pieces of FIG. *2a*.

Figure 3:
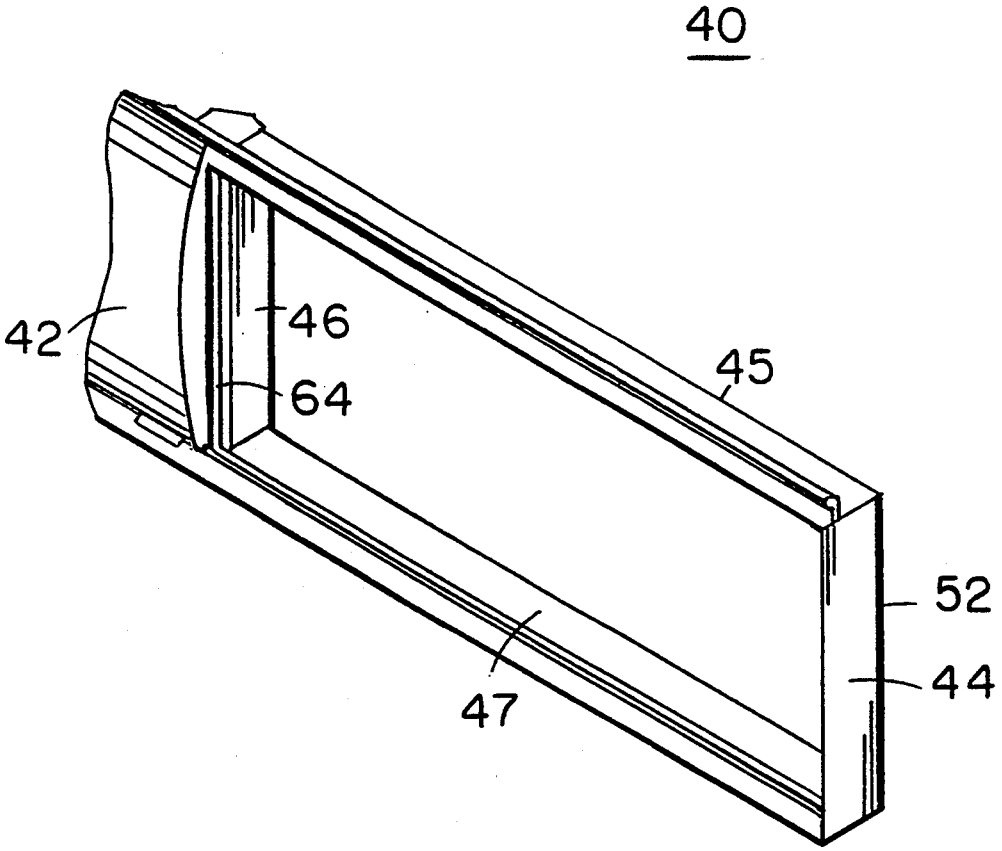

FIG. 3 is a perspective view of the doorframe section of the window and doorframe assembly.

Figure 4:
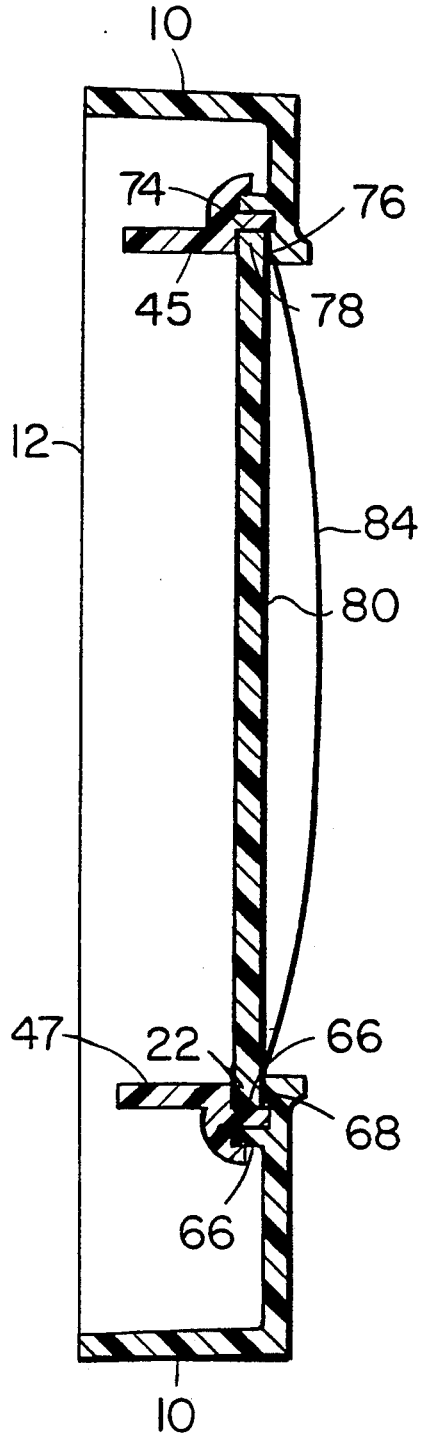

FIG. 4 is a cross section of the doorframe section of FIG. 3, taken along line 4–4 of FIG. 1 with the door, cover frame piece, and the window and doorframe piece in the assembled position, with the door and the cap piece shown in their assembled position.

DESCRIPTION OF THE EMBODIMENT

Referring first to FIG. 1, an identification panel and control panel comprises of a cover frame piece 10, a window and doorframe piece 40, a sliding door 80, and an artwork panel 90.

In a preferred embodiment, the cover frame piece 10 is made of molded plastic, in a color that blends with the front of the cabinet. The front surface 12 of the cover frame piece 10 is an elongated rectangle, in which there is an opening 14, which is also a rectangle, elongated along the axis of elongation of front surface 12 of the cover frame piece 10. On the top side 16 of the cover frame piece 10 are ridged tabs 18 which engage the back surface of the cabinet front (not shown in this view), and hold the identification banner in place.

The window and doorframe piece 40 is made of translucent molded plastic, incorporates an integral window section 42, and is generally an elongated rectangle when viewed from the front. The window section 42 is convex in cross section transverse to the axis of elongation of the front surface 12 of the window and doorframe piece 40. Ribs 44, 45, 46, and 47 frame a door opening 52.

The convex cross section of window section 42 creates a "lens effect." The lens effect can be created by a variety of different cross section geometries, such as elliptical, bowed, or "dished" (that is with a flattened front surface).

The sliding door 80 is made of translucent molded plastic. The sliding door 80 includes a rectangular planar section 82 and a handle section 84 at one end of the planar section 82 and extending perpendicularly from the plane of planar section 82. When viewed along a major axis of the planar section 82, the handle section 84 is convex in cross section transverse to the major axis of the planar section 82, with a curvature similar to curvature of the window section 42 of the window and doorframe piece 40.

The artwork panel 90 is planar and is made of photographic paper or another suitable artwork medium, which is laminated with a clear plastic.

The artwork panel 90 is die cut to create openings 92 with which tabs 54 in the window and doorframe piece 40 engage, to align the artwork panel 90 so that it can be viewed through the window section 42. Clips (not shown in this FIGURE) such as "tinnerman clips" on tabs 54 secure the artwork panel to the window and doorframe piece 40.

The window and doorframe piece 40 is attached to and aligned relative to the cover frame piece 10 by ridged deflectable tabs 22 (some of which are obscured in this view) which extend through openings 56 in window and doorframe piece 40.

Additional detail of the window and doorframe piece 40, the cover frame piece 10 and the artwork panel 90 assembly is shown in FIGS. *2a*, *2b* and *2c*. Ridged deflectable tab 22 on cover frame piece 10 extends through opening 56 in window and doorframe piece 40, holding the window and doorframe piece in position. Each tab 54 extends through an opening 92 in artwork panel 90. A clip 94 on tab 54 holds the artwork panel 90 in position relative to the window and doorframe piece 40. Thus, the artwork panel 90 can be viewed through window section 42. Additional artwork can be placed on the window section 42 to present a multilayer effect.

Figure 2B:
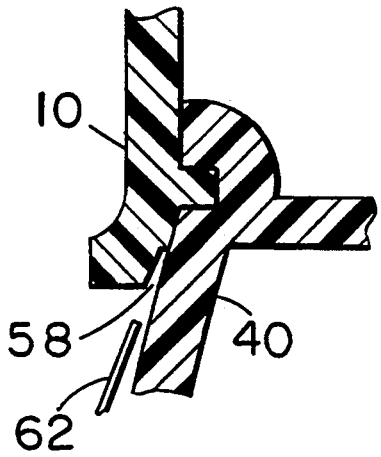
Figure 2C:
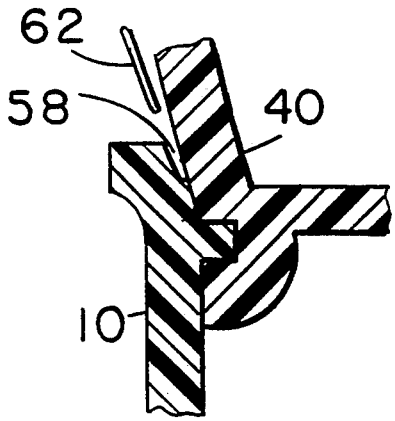
Figure 2A:
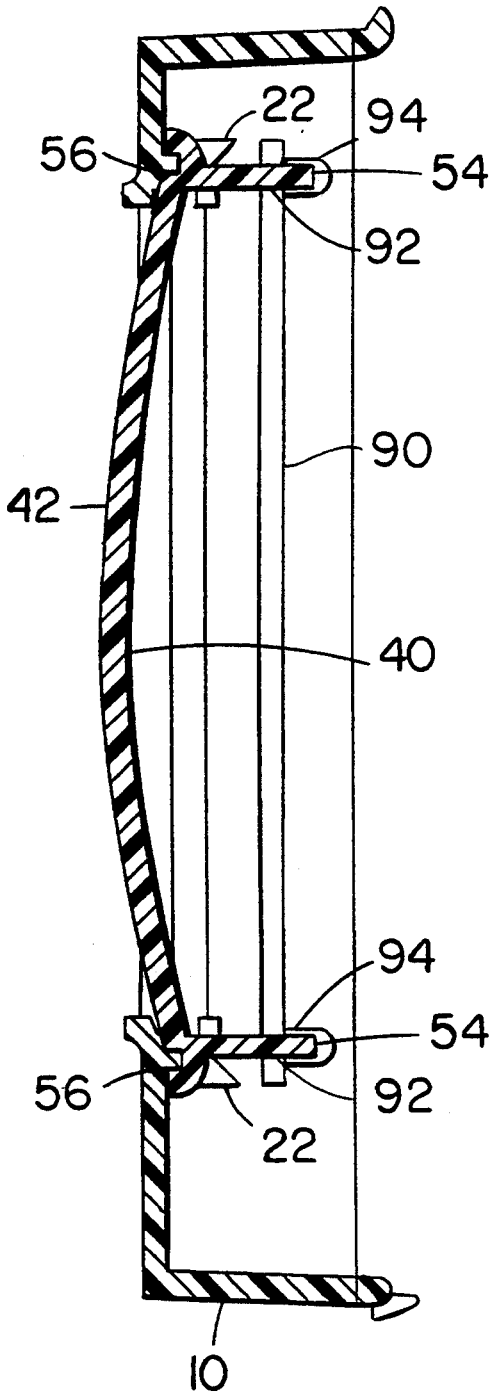

The cover frame piece 10 and the window and doorframe piece 40 are constructed so that there are thin (approximately 0.015 inches) gaps 58 between front of window section 42 and back of cover frame piece 10. Artwork is placed on a pliable rectangular translucent sheet 62. The translucent sheet 62 is installed by pinching opposite edges of the sheet to deform the sheet into an arcuate configuration, placing it in position adjacent to the window and doorframe piece 40 as indicated in FIG. 2, and releasing the pressure so that the edges of translucent sheet 62 partially recover and fit into thin gaps 58. The gaps 58 and the window and doorframe piece 40 are configured such that the translucent sheet 62 is urged against window section 42, and therefore retains the approximate shape of the cross section of window section 42. The translucent sheet 62 can also be easily removed by pinching the top and bottom edges of the translucent sheet 62 until the edges slide out of the thin gaps 58. The arcuate shape of the window section 42 and the translucent sheet 62 provide a lens effect which enhances the artwork on the artwork panel 90.

Thus the invention provides an apparatus for convenient product identification. A platform can be identified by distinctive artwork, or lettering, or both and placed on artwork panel 90. A model number can be identified by lettering on translucent sheet 62. Thus, modifying the model number in the manufacturing process or during an upgrade can be accomplished easily by replacing the translucent sheet 62.

Additional detail of the doorframe 52 is shown in FIG. 3. First side rib 44 is wider than top rib 45, second side rib 46, and lower rib 47, and thereby provides a stop for sliding door 80. Front edge of second side rib 46 and back of window section 42 of window and doorframe piece 40 form an opening 64 through which sliding door 80 can slide behind the window section 42.

Referring now to FIG. 4, the lower rib 47, together with 30 the flange 66 and the first back lip 68, form a lower channel 72 in which the sliding door 80 rests. Similarly, the upper rib 45, together with the flange 74 and the second back lip 76, both form an upper channel 78 which guides the sliding door 80.

The next level of assembly (not shown) is to place the assembled identification panel and control panel door assembly into a cutout in the front of the cabinet. The assembly is positioned such that the sliding door 80 covers the control panel when the door is in the closed position, and exposes the control panel when the door is in the open position.

Thus the embodiment of the invention provides an identification banner which has an effective multilayer visual effect, and which also provides for simple installation and change of model identification information, provides a control panel door, and has only three parts which are easily assembled. Other advantages of the invention will be apparent to those skilled in the art.

The embodiment of invention having thus been described, it will be apparent to those skilled in the art that the invention may be practiced in ways other than as specifically described, while remaining within the spirit and scope of the appended claims.

We claim:

1. An identification panel for an electronic equipment cabinet, comprising:

a window and doorframe member including:

a doorframe portion framing a generally rectangular opening, a window portion having a front and back, a door member, slidably mounted in said window and doorframe member having a first position in which said door member covers said generally rectangular opening and a second position in which said door member leaves said generally rectangular opening uncovered;

a translucent artwork sheet, means for mounting said artwork sheet such that said artwork sheet protrudes outwardly from said front of said window portion; and an artwork panel, mounted on said back of said window portion, so that said artwork panel is visible through said translucent artwork sheet.

2. An identification panel for an electronic equipment cabinet as claimed in claim 1, further comprising:

a translucent window section of said window portion, behind said artwork sheet, to support said sheet.

3. An identification panel for an electronic equipment cabinet as claimed in claim 2, wherein said translucent window section is arcuate about a major axis of said window portion.

4. An identification panel for an electronic equipment cabinet as claimed in claim 2, wherein said door member is translucent and wherein said door member in said second position lies between said translucent window section and said artwork panel.

5. An identification panel for an electronic equipment cabinet as claimed in claim 2, wherein said translucent window section and said window and doorframe member are a unitary assembly.

6. An identification panel for an electronic equipment cabinet, comprising:

a window and doorframe member comprising:

a doorframe portion defining a plane and framing a generally rectangular opening, a translucent window portion protruding outwardly from the plane defined by said doorframe portion, a door member, slidably mounted in said window and doorframe member having a first position in which said door member covers said generally rectangular opening and a second position in which said door member leaves said generally rectangular opening uncovered; and an artwork panel, mounted on the back of said window portion, so that said artwork panel is visible through said translucent window portion.

7. An identification panel for an electronic equipment cabinet, comprising:

a cover member defining an opening;

a generally rectangular window and doorframe member including:

a window portion, convex in a cross section transverse to an axis of elongation of said generally rectangular window and doorframe member;

said window and doorframe member mounted to said cover member so that a surface of said window portion of said window and doorframe member protrudes through the opening defined by said cover member said window and doorframe member further mounted to define a channel between said window and doorframe member and said cover member;

a generally rectangular opening in said window and doorframe member;

a door member, slidably mounted in said channel, so that said door member covers said rectangular opening in one position and so that said door member leaves said rectangular opening uncovered in a second position; and an artwork panel, mounted on said window and doorframe member, so that said artwork panel is visible through said window portion.

8. An identification panel for an electronic equipment cabinet as claimed in claim 7, further comprising posts on said window and doorframe member, said posts engaging openings in said artwork panel, wherein said posts extend through said artwork panel to secure said artwork panel in position relative to said window and doorframe member.

9. An identification panel for an electronic equipment cabinet as claimed in claim 7, further comprising ridged deflectable tabs extending from said cover member and engaging with openings in said window and doorframe member to hold said window and doorframe member in position relative to said cover member.

* * * * *